US008776643B2

(12) United States Patent
Emmert

(10) Patent No.: US 8,776,643 B2
(45) Date of Patent: Jul. 15, 2014

(54) INDEXABLE TOOL

(75) Inventors: Sidney Quinn Emmert, Oklahoma City, OK (US); Sonya Emmert, legal representative, Oklahoma City, OK (US)

(73) Assignee: DentCraft Tools Limited Partnership, Oklahoma City, OK (US)

( * ) Notice: Subject to any disclaimer, the term of this patent is extended or adjusted under 35 U.S.C. 154(b) by 7 days.

(21) Appl. No.: 13/421,587

(22) Filed: Mar. 15, 2012

(65) Prior Publication Data

US 2013/0239756 A1 Sep. 19, 2013

(51) Int. Cl.
*B25F 1/02* (2006.01)
*B25B 23/16* (2006.01)
*B25G 1/01* (2006.01)

(52) U.S. Cl.
USPC ..... 81/177.1; 7/167; 81/489

(58) Field of Classification Search
USPC ..... 81/489–492; 7/167–170
See application file for complete search history.

(56) References Cited

U.S. PATENT DOCUMENTS 2,337,514 A * 12/1943 Wilcox ..... 408/132
2,756,792 A * 7/1956 Hirschman ..... 81/28
3,208,317 A * 9/1965 Duchesne ..... 81/177.1
3,605,521 A 9/1971 Glenn
4,086,831 A * 5/1978 Smith ..... 81/62
4,627,761 A * 12/1986 Olson et al. ..... 403/324
4,696,208 A 9/1987 Lay
4,978,244 A * 12/1990 Lange ..... 403/379.2
5,385,420 A * 1/1995 Newman et al. ..... 403/299
5,433,552 A * 7/1995 Thyu ..... 403/378
5,647,389 A 7/1997 Holloway
5,682,641 A * 11/1997 Newman et al. ..... 16/429
5,749,271 A * 5/1998 Liu ..... 81/60
5,832,791 A * 11/1998 Lin ..... 81/62
6,170,123 B1 1/2001 Holland-Letz
6,240,810 B1 * 6/2001 Ho ..... 81/62
6,485,031 B2 * 11/2002 Chen ..... 279/83
6,553,628 B2 * 4/2003 Newman et al. ..... 16/427
6,588,304 B2 7/2003 Kady et al.
6,874,201 B2 * 4/2005 Ta et al. ..... 16/429
7,156,003 B2 1/2007 Cole

* cited by examiner

*Primary Examiner* — David B Thomas
*Assistant Examiner* — Danny Hong
(74) *Attorney, Agent, or Firm* — Hall Estill Attorneys at Law

(57) ABSTRACT

A tool may be configured, in various embodiments, with a handle capable of housing house a gear in an aperture. The gear can have at least a predetermined number of facets and an orbital ring. A securing feature can have a first notch that is adapted to engage the orbital ring to allow rotational movement while securing the gear within the aperture.

20 Claims, 5 Drawing Sheets

INDEXABLE TOOL

SUMMARY

Various embodiments are generally directed to an indexable tool that may be configured with a handle capable of housing house a gear in an aperture. The gear can have at least a predetermined number of facets and an orbital ring. A securing feature can have a first notch that is adapted to engage the orbital ring to allow rotational movement while securing the gear within the aperture.

DETAILED DESCRIPTION

Various embodiments or indexable tool capable of securely articulating a gear, particularly a gear connected to a shaft associated with repairing surface imperfections, such as dents, are generally disclosed herein. In a number of different industries, tools may consist of handles and attachments that can be used in a variety of positions, but such positions can strain the connection between handle and attachment. The strain can degrade performance and cause separation of the handle and attachment at the detriment of work efficiency and accuracy.

The degradation of performance may further be exacerbated in occupational situations that selectively rotate a tool attachment while strain is placed on the connection between the handle and attachment, such as when the attachment is rotated while upside down. Hence, a tool that allows for selective rotation of a tool attachment while securing the attachment in a handle regardless of the position of the tool provides enhanced tool performance and efficiency that corresponds with heightened industry demand.

Accordingly, a tool may be configured with at least a handle capable of housing a gear in an aperture of the handle. The gear can be constructed with at least a predetermined number of facets and a retention ring. A securing feature of the handle can have a first notch that is adapted to engage the retention ring to allow rotational movement while securing the gear within the aperture. The ability to selectively rotate the gear while the gear is secured within the aperture allows for rotational adjustment of the gear, and any shaft affixed to the gear, to a wide range of angular orientations with minimal effort and time regardless of the position of the tool.

Figure 1A:
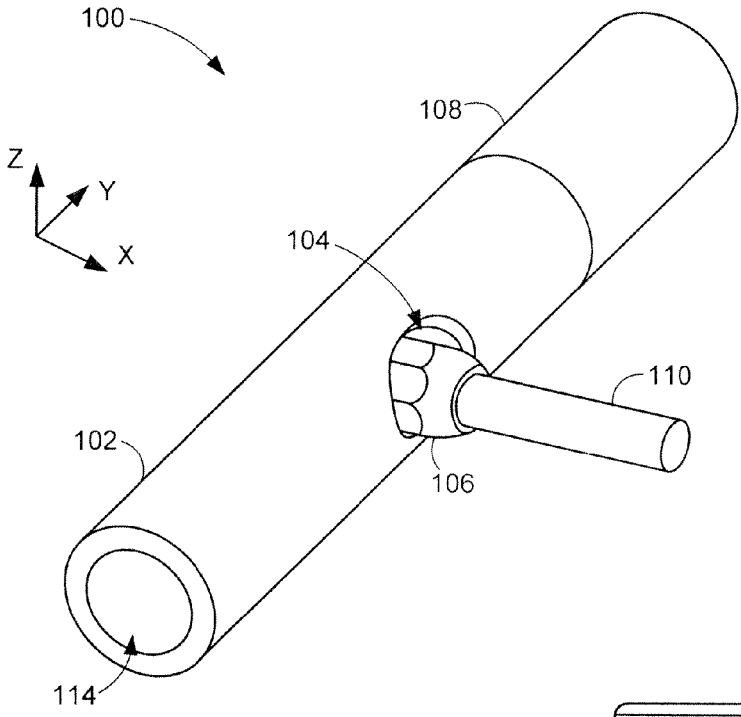
FIGS. 1A and 1B respectively provide perspective and plan views of an exemplary articulable shaft tool.
Figure 1B:
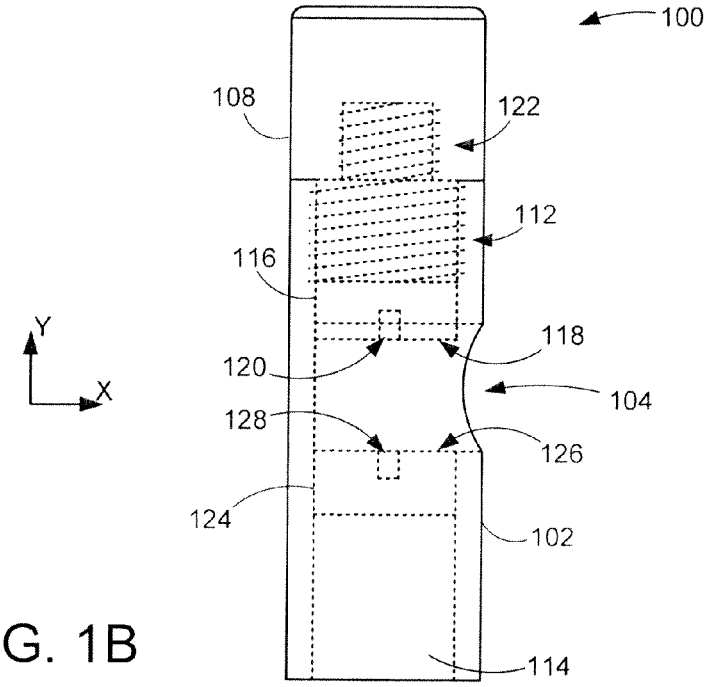

Turning to the drawings. FIGS. 1A and 1B respectively show independent views of an example articulating shall tool 100 constructed in accordance with various embodiments. As shown in FIG. 1A, the tool 100 has a number of external components that may include at least a handle 102 configured with a gear aperture 104 that provides access for a gear 106 to an internal cavity of the handle 102. The handle 100 may further be configured to connect to a securing member 108 that engages the portions of the gear 106 to secure the gear 106, and the shaft 110 affixed to the gear 106, in a predetermined angular orientation with respect to the handle 102.

FIG. 1B displays various internal components of the tool 100 of FIG. 1A without the gear 106 and shaft 110 secured in the gear apart 104 of the handle 102. The segmented internal features of the various components reveal that while not required or limited, the securing member 108 has a first threaded connection 112 on a first longitudinal end of the handle 102, along the Y axis. Meanwhile, a second longitudinal end of the handle 102 has an extension feature 114 that may be a variety of designs, such as the counter bore shown in FIGS. 1A and 1B, that allow an extension member (not shown) to elongate the longitudinal axis of the handle 102 and provide increased leverage for tool 100 operation.

With manipulation of the securing member 108 to a first secured position, a securing feature 116 may be advanced into the aperture 104 to provide a securing surface 118 and notch 120 configured to secure various aspects of the gear 106 of FIG. 1A. The amount of manipulation needed to translate the securing feature 116 from the secured first position to an unsecured position may be reduced by configuring the securing feature 116 with a second threaded connection 122 that is counter-threaded in relation to the first threaded connection 112.

While not required or limited, the first and second threaded connections 112 and 122 can be tuned to provide a predetermined amount of longitudinal travel for the securing feature 116 that corresponds to a predetermined number of turns for the securing member 108. Such tuning may consist of configuring the first and second threaded connections 112 and 122 with differing pitches, such as 14, 16, and 18 turns per inch.

The presence of the securing feature 116 on at least one side of the gear aperture 104 can be complemented by a securing plug 124 that may be fixed or adjustable in relation to the gear aperture 104, opposite the securing feature 116. The securing plug 124 can be constructed to match or be dissimilar to the securing feature with a friction surface 126 that complements a plug securing notch 128 and is aligned with the securing notch 120 of the securing feature 116. With the securing feature 116 and plug 124 positioned on opposite sides of the gear aperture 104, the gear 106 can be selectively locked within the housing through contact with the securing feature 116 and plug 124, without concern for rotational and transverse movement, along the X axis, in relation to the handle 102.

It should be noted that the various components and features of the tool 100 can individually or collectively be altered from that shown in FIGS. 1A and 1B, as desired. Hence, the size, shape, position, and orientation of the tool 100 are not limited and can be modified in various embodiments of the present disclosure. In one such modified embodiment, the aperture 104, plug 124, and securing feature 116 are positioned at a longitudinal end of the handle 102 and configured to orient the gear 106 and shaft 110 in a non-orthogonal relationship with the handle 102.

Figure 2A:
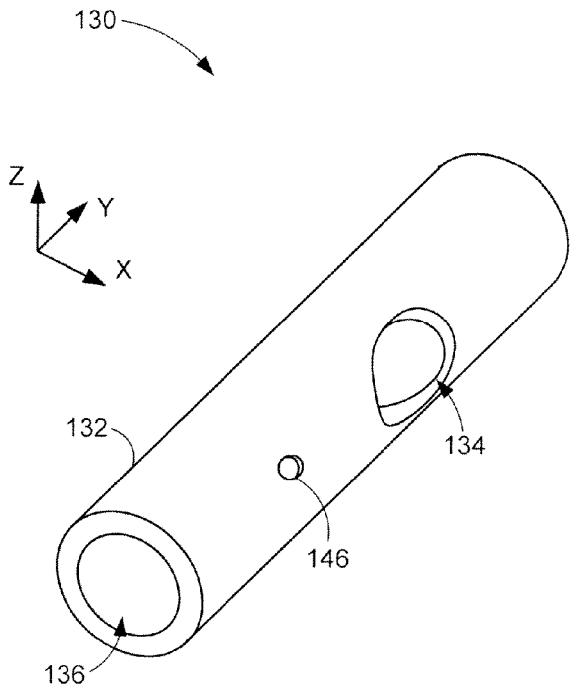
FIGS. 2A and 2B respectively show perspective and plan views of various portions of an example articulable shaft tool.
Figure 2B:
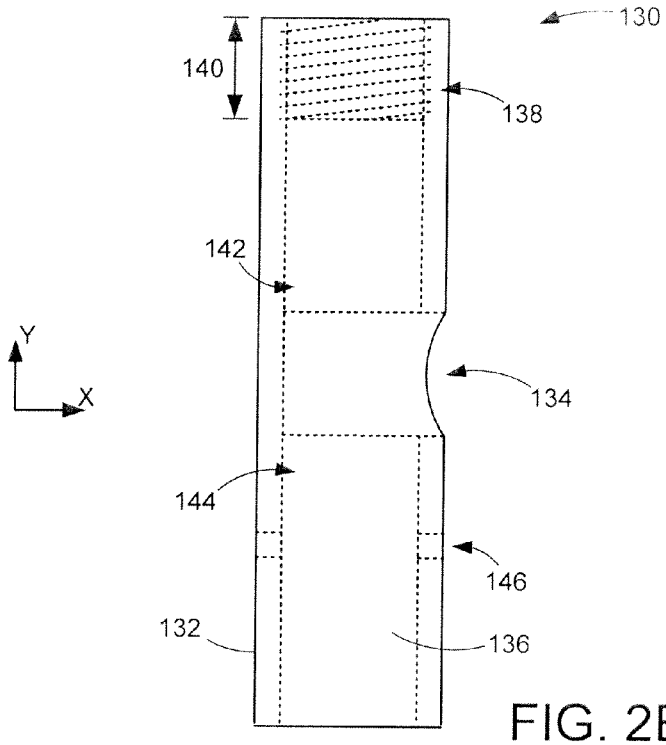

FIGS. 2A and 2B respectively show perspective and plan views of in example tool handle 130 stripped of any attachments or connections associated with various embodiments. FIG. 2A shows a tool housing 132 with predetermined internal and external dimensions, such as diameter, length, and width. The housing 132 can have one or more gear apertures 134 defined by a bore through a portion of the sidewall of the housing 132. While a single circular gear aperture 134 is configured substantially in the middle of the housing 132, such construction is not required or limited. For example, one or more non-circular apertures can be formed with a non-normal orientation to the housing 132 at a longitudinal end of the housing 132, which can provide a greater load beam and leverage for a tool without extending the longitudinal length of the housing 132 by engaging the extension feature 136.

The internal aspects of the housing 132 displayed by the segmented lines in FIG. 2B illustrate how the housing can be configured with predetermined locations for components, such as the securing feature 116 and plug 124 of FIG. 1B, prior to assembly of a tool. The housing 132 can have a threaded connection 138 with a predetermined length 140 and number of turns while the size and position of the gear aperture 134 in the housing 132 can correlate with the size and orientation of securing feature and plug regions 142 and 144. That is, the securing feature and plug regions 142 and 144 can be tuned and optimized, such as with tapered internal sidewalls and shaped cross-sections, to provide secure positioning on opposite sides of the gear aperture 134.

The position of the securing plug region 144 can further dictate the location and orientation of a retention aperture 146 capable of securing a retention feature that maintains the securing plug in the securing plug region 144 throughout operation. It can be appreciated that a variety of retention means can be used to affix the securing plug via the retention aperture 146, such as pins, screws, rivets, and magnets. Likewise, a number of similar or dissimilar retention means can be used to retain the securing plug without limitation. For example, the retention aperture 146 may extend through opposite sidewalls of the housing 132 to allow a single pin to traverse through the housing 132 or a screw on a first side and a rivet on the second side.

Figure 3:
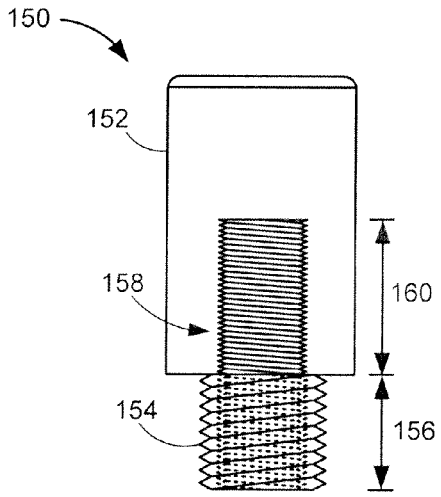
FIG. 3 displays a portion of an example securing member of an articulable shaft tool constructed in accordance with various embodiments.

FIG. 3 provides a portion of an example securing member 150 capable of being used in the tool handle 130 of FIGS. 2A and 2B. While not limited to the configuration shown in FIG. 3, the portion of the securing member 150 can have a body 152 with a first fastening means 154, such as threads, keyed transitions, and magnets, that allows the securing member 150 to secure to a predetermined fastening area of a tool handle, like the threaded connection 138 of FIG. 1B. The first fastening means 154 can be tuned by altering a variety of characteristics, like first fastening length 156 from the body 152 and number of threads per inch, to provide optimized engagement between the securing member 150 and the tool handle.

In some embodiments, the number of threads per inch is selected from the range of 10-30 so that a predetermined number of turns of the securing member 150 correspond to a predetermined longitudinal translation. That is, the first fastening means 154 can be configured so that less than one turn moves the securing member 150 between a secured position where the shaft, such as shall 110 of FIG. 1A, is locked in place and an adjustment position where the shaft is free to rotate while remaining secured within the tool handle.

While the securing member 150 can be a single piece of various non-limiting materials, like stainless steel, plastic, and carbon fiber, the member 150 can be constructed to accept at least one additional member with a second fastening means 158 that continuously extends through the first fastening means 154 into the body 152 for a second fastening length 160. The second fastening means 158 can be configured to be similar or dissimilar to the first fastening means 154. For example, the second fastening means 158 can be constructed with a counter-thread that turns opposite to the threads of the first fastening means 154.

Figure 4:
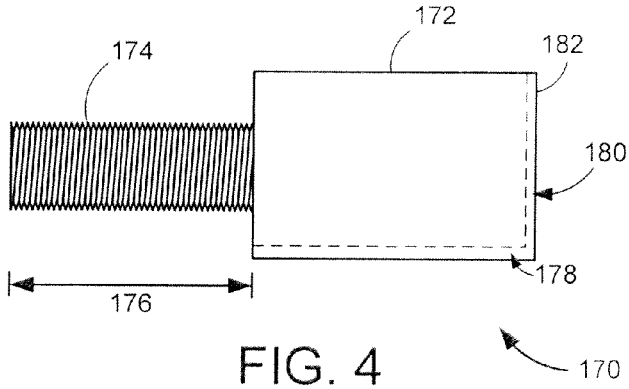
FIG. 4 illustrates a portion of an example securing member an articulable shaft tool constructed in accordance with various embodiments.

FIG. 4 generally illustrates an example securing feature 170 capable of being used with the securing member 150 of FIG. 3. A securing body 172 has a fastening means 174 that extends from the body 172 a predetermined securing length 176. The fastening means 174 can be configured to correspond with the second fastening means 158 of FIG. 3 to allow the securing feature 170 to be nested within the securing member 150. The configuration of the length 176 and fastening manner, such as thread pitch and magnet strength, allows the securing feature 170 to have tuned orientation to the securing member 150 and tool handle while the securing member 150 is manipulated.

The tuned orientation of the securing feature 170 can be facilitated at least in part by the longitudinal groove 178 that can extend partially or completely across the body 172. The longitudinal groove 178 may be a uniform or varying depth configured to control the movement of the securing member 170 as the corresponding securing member 150 is manipulated from a gear locking first position to an unlocked second position, such as by fitting a set screw or pin positioned interior to the tool handle.

As shown, but not required or limited, the securing member 170 can have retention groove 180 that partially or wholly extends across a retention surface 182 of the member 170. The retention groove 180 and surface 182 can be configured in a variety of manners, such as groove depth, transverse length, and retention surface shape, to securely engage a gear while allowing the gear to rotate through contact between a retention ring portion of the gear and at least the retention groove 180. In some embodiments, the securing surface 182 and retention groove 180 have a predetermined design that can be continuously linear and curvilinear to selectively engage particular portions of the gear, such as the retention ring, and provide multiple securing positions, like locking the gear from rotational and egress from the tool handle.

Figure 5A:
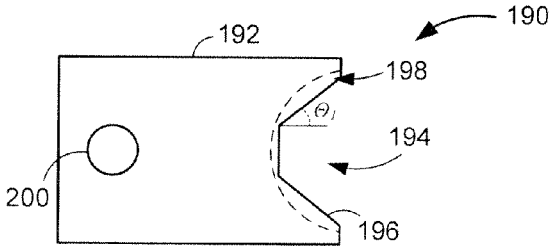
FIGS. 5A and 5B display side and front views of portions of an example articulable shaft tool constructed in accordance with various embodiments.
Figure 5B:
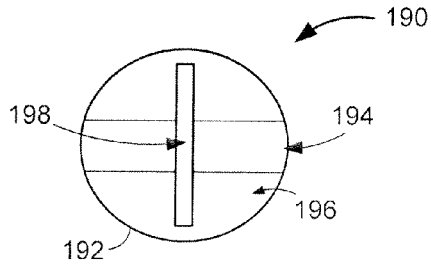

The securing member 170 may be employed individually to secure a gear or may be used in conjunction with a fixed plug engaging an opposite side of the gear, such as the example securing plug 190 displayed in the side and front views of FIGS. 5A and 5B. The plug 190 can have a shaped core 192, that may or may not conform to the interior shape of the tool handle. As shown in FIG. 5A, an engagement region 194 can have one or more sloped surfaces 196 angled at a predetermined angle $\theta_1$ that provides increased surface area to engage the gear as opposed to the continuously linear securing surface 182 of FIG. 4.

Some or all of the engagement region 194 can be occupied by a retention notch 198 configured to engage and secure a portion of a gear. While the plug 190 can be configured to longitudinally translate in relation to a tool handle, much like securing member 150 of FIG. 3, the plug 190 may be temporarily or permanently fixed in a predetermined location within the tool handle by engaging, the locking aperture 200 with a fastening means, such as a pin, screw, glue, and welding. The position and size of the locking aperture 200 can be optimized to correspond to one or more apertures in the tool handle, like the retention aperture 146 of FIG. 2B.

Various embodiments tune characteristics of the retention notch 198 and engagement region 194, such as position, shape, and depth, to allow both locking of the gear in a selected angular orientation and rotation of the gear while maintaining the gear in the tool handle, as displayed in FIG. 5B. That is, the sloped surfaces 196 and retention notch 198 can be constructed to substantially match the shape of various aspects of the gear, such as faceted sides and a retention ring. In an example configuration not shown in FIG. 5B, the sloped surfaces 196 can be configured to meet without a connecting surface to form a "V" shape while the retention notch 198 has a rectangular depth, as opposed to the continuously curvilinear depth shown in FIGS. 5A and 5B. Accordingly, the plug 190 can be constructed in response to the design or a gear to provide a myriad of engagement and securing positions between the plug 190, gear, and securing member 170.

Figure 6A:
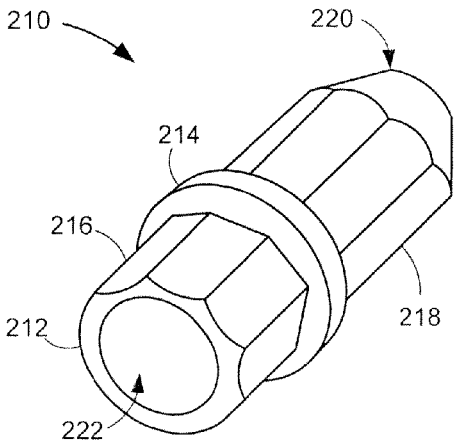
FIGS. 6A and 6B respectively show perspective and front views of an example gear capable of being used in an articulable shall tool.
Figure 6B:
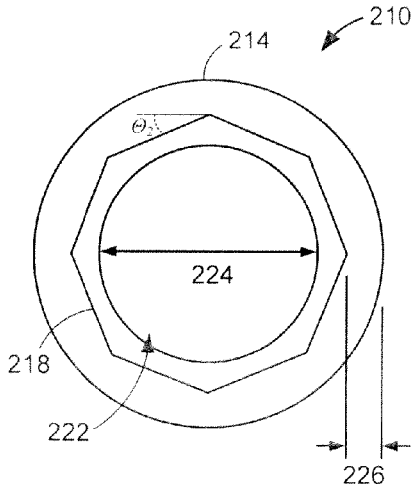

FIGS. 6A and 6B respectively show perspective and top views of an example gear 210 constructed in accordance with various embodiments. The gear 210 may be formed from a single piece of material or be an assembly of components constructed to provide at least a gear body 212 and retention ring 214. The retention ring 214 can be shaped and positioned at any location on the body 212, which may separate the exterior of the body 212 into first and second engagement surfaces 216 and 218.

Some embodiments configure the engagement surfaces 216 and 218 into a predetermined number of facets that consist of a series of linear surfaces allowing increased surface area contact between the engagement surfaces 216 and 218 and the respective securing plug and securing member. The number and orientation of the facets of the first and second engagement surfaces 216 and 218 are not required to match and can be constructed with or without facets altogether. Likewise, at least one tip 220 of the gear 210 can be tapered to allow the permanent attachment of a shaft within a bore 222. Such configuration possibilities allow the gear 210 to have multiple engagement features that can provide enhanced securement and indexing within the tool handle.

FIG. 6B further illustrates that the gear 210 can be partially or completely hollow through the construction of the central bore 222 with a predetermined inner diameter 224. The diameter 224 may be selected to provide a predetermined sidewall thickness that allows the second engagement surface 218 to be faceted at a particular angle $\theta_2$ while maintaining rigidity and strength against rotational and tensile forces. The retention ring 214 may be configured with a particular sidewall length 226 that extends from the engagement surface 218 to allow contact with the retention ring 214 without contacting the engagement surface 218. It should be noted that the retention ring 214 is not limited to a single sidewall length 226 as the ring 214 can have a variably sizes sidewall in various embodiments.

Figure 7A:
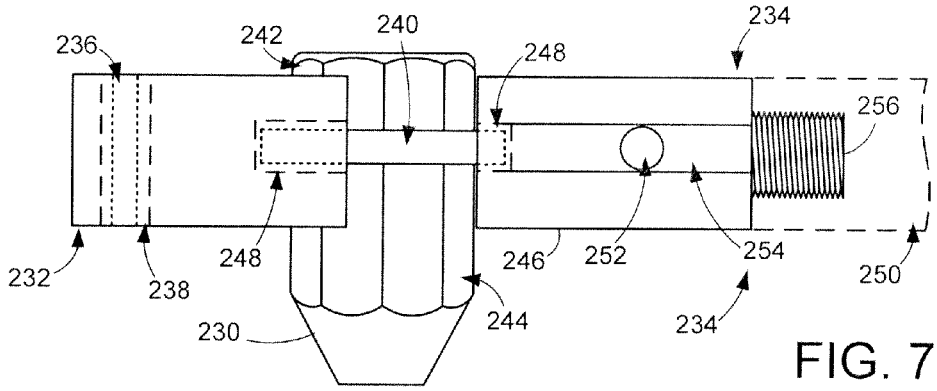
FIGS. 7A and 7B generally illustrate various example engagement positions capable with operation of an articulable shall tool in accordance with various embodiments.
Figure 7B:
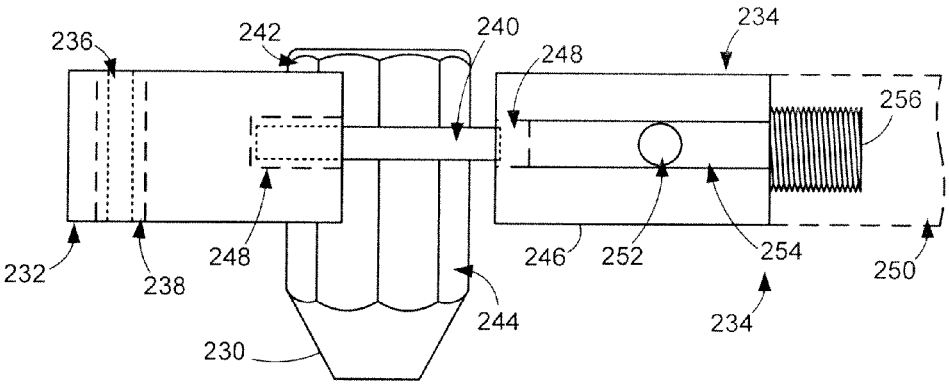

FIGS. 7A and 7B generally illustrate an example tool handle environment and manner in which the various aspects of the present disclosure can be practiced. FIG. 7A has a gear 230 positioned between a retention plug 232 and a securing member 234, with the plug 232 fixed in place by a retention pin 236 extending through a retention aperture 238. The gear has a continuous peripheral retention ring 240 disposed between faceted first and second engagement surfaces 242 and 244. The plug 232 and securing feature 246 portion of the securing member 234 are each constructed with retention notches 248 configured to allow concurrent engagement of at least the retention ring 240. The retention notches 248 further allow securing contact between the plug 232, securing feature 246, and faceted engagement surfaces 242 and 244.

When a securing knob 250 is manipulated to a first predetermined position in relation to a tool handle, such as handle 132 of FIG. 2A, the gear 230 is locked, as shown in FIG. 7A, through the contact of the retention ring 240 by the retention notch 248 simultaneously with the contact of the engagement surfaces 242 and 244 by the plug 232 and securing feature 246. That is, the contact with the retention ring 240 retains the gear 230 within the handle while rotational movement is prevented by the concurrent contact of the facets of the first and second engagement surfaces 242 and 244.

As the securing knob 250 is altered, for instance through threaded rotation with the tool handle, to a second predetermined position, the retention notch 248 maintains contact with the retention ring 240 while the securing feature disengages the facets of the first and second engagement surfaces 242 and 244. Such retention ring 240 engagement in conjunction with the securing feature 246 disengagement allows for the gear 230 to be indexed either manually or automatically to a variety of angular orientations. In some embodiments, the plug 232 and securing feature 246 each move in opposing directions to further minimize interference with indexing the gear 230.

The motion of the securing member 234 that alters the position of the seeming feature 246 in relation to the gear 230 can be harnessed by positioning a guide pin 252 in a longitudinal groove 254 of the securing feature 246. The configuration of the longitudinal groove 254 can be tuned to ensure the retention notch 248 maintains an orientation with the retention ring 240 despite rotational articulation of the securing knob 250 and longitudinal movement of the securing member 234. The guide pin 252 also can maintain the retention notch 248 orientation while the securing knob 250 is rotated in a first direction and the securing feature 246 extends in response to the threaded connection 256 being counter-threaded.

The guide pin 252 and longitudinal groove 254 configurations may further provide limits on the longitudinal movement of the securing member 234. Such limits can prevent inadvertent extraction of the securing member 234 from the tool handle while attempting to translate the securing feature 246 to a third predetermined position where the retention notch 248 is disengaged from the retention ring 240, allowing enough space to extract the gear 230 from the tool handle.

In a summary of a variety of embodiments of an example indexable securing member 234 can be manipulated to a first predetermined position, shown by FIG. 7A, where the gear 230 is locked to prevent rotational movement through contacting interaction between the facets of the first 242 and second 244 engagement surfaces, the securing plug 232, and the securing feature 246. Manipulation of the securing member 234 can longitudinally move the securing feature 246 so that the retention 240 engages the retention notch 248, preventing the gear 230 from dislocating from the tool handle, while allowing rotational indexing of the gear 230 due to the lack of contact between the securing feature 246 and the various faceted surfaces 242 and 244.

Further articulation of the securing member 234 can correspond to additional longitudinal movement and a third predetermined position where the securing feature 246 is disconnected from the gear 230 to the point that the gear 230 can be removed from the tool handle, regardless of whether the securing plug 232 is moved in relation to the gear 230 and tool handle. It should be noted that the first, second, and third predetermined positions of the securing member 234 in relation to the gear 230 are merely exemplary in nature and may be modified, as desired, to accommodate a variety of gear engagement positions. For example, the securing member 234 may be configured to rotate the gear 230 through selection of a button or lever external to the tool handle.

Figure 8:
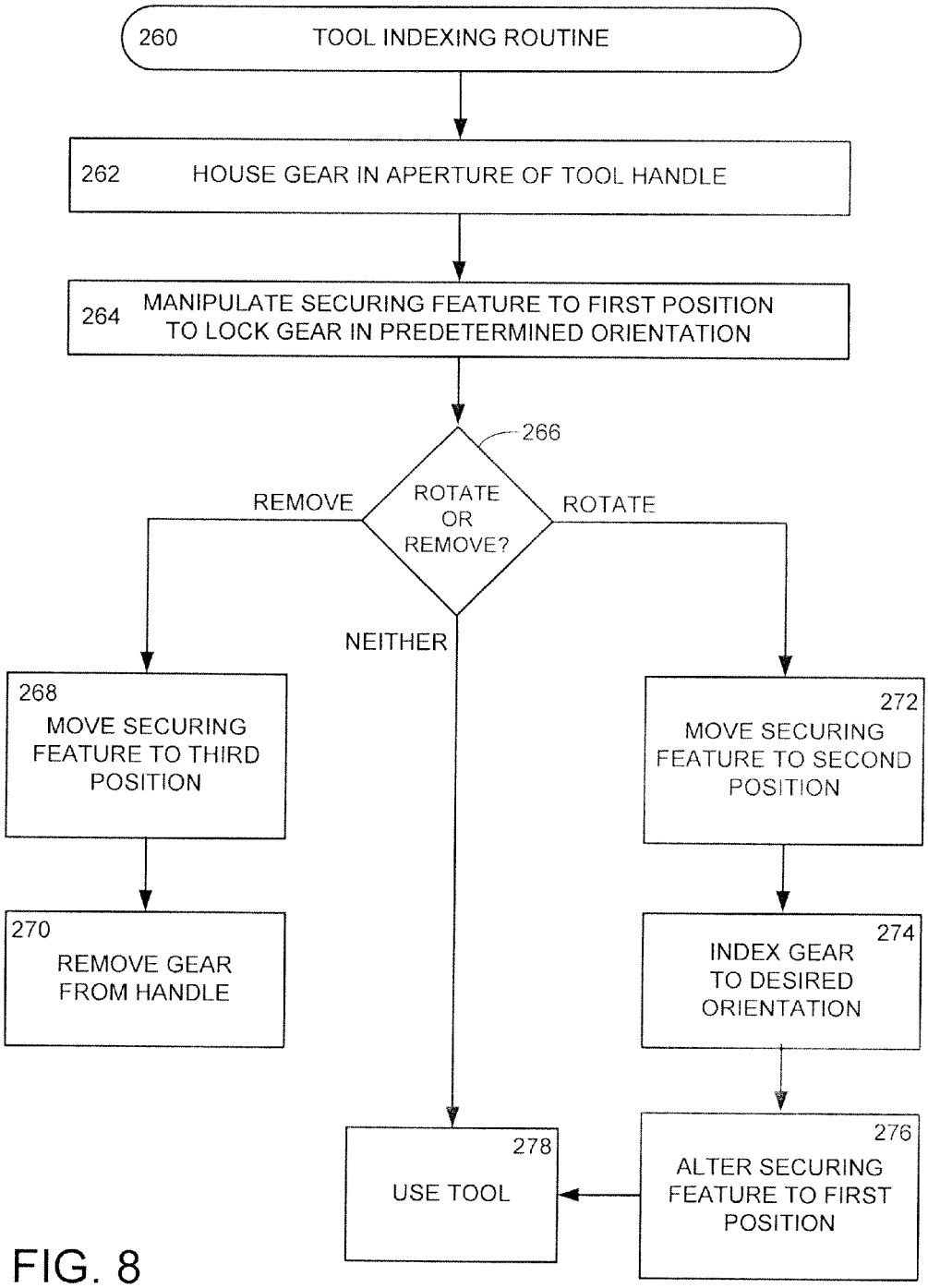
FIG. 8 provides a flowchart of an example tool indexing, routine illustrative of steps carried out in accordance with various embodiments.

FIG. 8 provides a flow chart for a tool indexing routine 260 performed in accordance with various embodiments. The routine begins at step 262 by housing at least one gear in an aperture of a tool handle. As discussed above, the tool handle, aperture, and gear can be configured in a variety of non-limiting manners. Step 264 then manipulates a securing feature component of the tool handle into a first position that locks the gear in a predetermined orientation, preventing rotational movement while securing the gear in the tool handle. The first position may have concurrent engagement of faceted and retention ring aspects of the gear to prevent gear movement.

With the gear secured in the tool handle, decision 266 evaluates how the tool is to be used. One of an unlimited number of options can be the determination to remove the gear from the handle. Step 268 moves the securing feature to a third position where the faceted surfaces and retention ring portions of the gear are not secured against the securing feature, which corresponds to providing enough room that the gear can be manually or automatically removed from the handle in step 270.

Returning to decision 266, if a determination is made to alter the orientation f the gear with respect to the tool handle, step 272 moves the securing feature to a predetermined second position where the retention ring of the gear is engaged, but the faceted surfaces are not. Such configuration allows for indexing of the gear to any number of angular orientations in step 274. The number and position of indexable angular orientations may correspond to the number and size of the faceted surfaces of the gear. For example, a 12 faceted engagement surface can provide indexable orientations at 30 degree increments and an 8 faceted configuration can provide 45 degree indexed positions.

Next, step 276 alters the securing feature back to the first position to secure the gear and allow the tool to be used in step 278. In the event that the initial indexed position of the gear is acceptable in decision 266, the routine 260 can proceed directly to step 278.

Through the various possible functions of an indexable tool shown in routine 260, a user can use and selectively alter the angular orientation of the gear in the tool handle. However, routine 260 is not limited to the steps and decisions displayed in FIG. 8. In fact, the various aspects of the routine 260 can be changed, omitted, or moved and additional steps and decisions can be added, without deterring from the spirit of the present disclosure. For example, at least one step of installing a different second gear into the handle and using that gear after returning the securing feature to the first position can be added after the initial gear is removed from the handle in step 270.

As can be appreciated by one skilled in the art, the various embodiments illustrated herein can provide a tool that can be efficiently indexed to a variety of angular orientations. The ability to adjust the securing feature to lock, rotate, and remove the gear may allow for the interchanging of gears and handle orientations with respect to the gear. The tool can be configured so that the securing feature has a counter-thread that can allow manipulation between the first, second, and third positions with less than a full turn, which can correspond to single handed operation.

Moreover, the retention ring of the gear and securing feature can be tuned to allow efficient gear indexing without concern for the gear inadvertently exiting the handle. As such, the tool can be used and efficiently adjusted upside down. It will be appreciated that the various embodiments discussed herein have numerous potential applications and are not limited to a certain field of electronic media or type of data storage devices.

It is to be understood that even though numerous characteristics and advantages of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. An indexable tool comprising:

a handle configured to house a gear in an aperture, the gear having a predetermined number of facets and a retention ring;

a securing feature having a first notch adapted to engage opposing sidewalls of the retention ring from a first longitudinal side of the gear; and a securing plug having a second notch adapted to engage opposing sidewalls of less than all of the retention ring from a second longitudinal side of the gear, the first and second notches respectively shaped to contact multiple different surfaces of the retention ring when the securing feature is in a first position relative to the handle and the first notch adapted to separate from the retention ring when the securing feature is in a second position relative to the handle, the second position of the securing feature configured to allow rotational movement of the gear while preventing transverse movement of the gear in opposite first and second directions within the aperture.

2. The indexable tool of claim 1, wherein each notch is configured to engage the retention ring with and without engaging the predetermined number of facets.

3. The indexable tool of claim 1, wherein the securing feature is nested within the handle.

4. The indexable tool of claim 1, wherein the second notch is adapted to contact the predetermined number of facets of the gear while the first notch is adapted to separate from the retention ring when the securing feature is in a second position relative to the handle.

5. The indexable tool of claim 4, wherein the securing feature prevents rotational and longitudinal movement while in the first position relative to the handle.

6. The indexable tool of claim 4, wherein the gear can be removed from the aperture when the securing feature is in a third position relative to the handle.

7. The indexable tool of claim 1, wherein the securing feature has a threaded engagement with the handle.

8. The indexable tool of claim 7, wherein the securing feature has a first portion counter-threaded into a second portion, the first portion having the first notch.

9. The indexable tool of claim 1, wherein the securing feature is retained by a protrusion extending through at least a portion of the handle.

10. The indexable tool of claim 1, wherein the securing plug has a plurality of sloped surfaces shaped to match the predetermined number of facets in the gear.

11. The indexable tool of claim 10, wherein the second notch is configured to concurrently engage the retention ring and at least one of the predetermined number of facets of the gear.

12. The indexable tool of claim 10, wherein at least one of the sloped surfaces is planar.

13. The indexable tool of claim 10, wherein the securing feature comprises a planar retention surface that concurrently engages at least one of the predetermined number of facets of the gear along with the sloped surfaces of the securing plug.

14. The indexable tool of claim 10, wherein the second notch has a curvilinear surface dissimilar from the shape of the sloped surfaces.

15. The indexable tool of claim 1, wherein the handle has an extension feature distal the aperture, the extension feature capable of receiving an extension protrusion.

16. The indexable tool of claim 1, wherein the securing feature has a shape that matches the handle and a grooved notch that continuously extends along the longitudinal axis of the securing feature.

17. A method comprising:

housing a gear in an aperture of a handle, the gear having a predetermined number of facets and an retention ring; and engaging a first longitudinal side of the gear with opposing sidewalls of the retention ring with a first notch of a securing feature; and engaging a second longitudinal side of the gear with opposing sidewalls of less than all of the retention ring with a second notch of a securing plug the first and second notches respectively shaped to contact multiple different surfaces of the retention ring when the securing feature is in a first position relative to the handle and the first notch adapted to separate from the retention ring when the securing feature is in a second position relative to the handle, the second position of the securing feature configured to allow rotational movement of the gear while preventing transverse movement of the gear in opposite first and second directions within the aperture.

18. The method of claim 17, further comprising adjusting the securing feature to engage both the predetermined number of facets and the retention ring and secure the gear in a predetermined orientation.

19. The method of claim 17, further comprising adjusting the securing feature to disengage both the predetermined number of facets and the retention ring to allow removal of the gear from the aperture.

20. A gear comprising:

a body having a predetermined number of facets on opposite sides of a retention ring, the retention ring continuously extending about the body to allow peripheral engagement of retention ring without engagement of the predetermined number of facets.

* * * * *